US006956164B2

(12) United States Patent
Brown

(10) Patent No.: US 6,956,164 B2
(45) Date of Patent: Oct. 18, 2005

(54) INNER CONDUCTOR SUPPORTS FOR RIGID COAXIAL TRANSMISSION LINES

(75) Inventor: Jeffrey Brown, Windham, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/742,927

(22) Filed: Dec. 23, 2003

(65) Prior Publication Data

US 2005/0133232 A1 Jun. 23, 2005

(51) Int. Cl.[7] ..... H01B 9/00
(52) U.S. Cl. ..... 174/28

(58) Field of Search ..... 174/28, 99 B

(56) References Cited

U.S. PATENT DOCUMENTS 3,344,370 A * 9/1967 Sewell ..... 333/244
3,349,168 A * 10/1967 Rehder et al. ..... 174/99 B

* cited by examiner

*Primary Examiner*—Chau N. Nguyen
(74) *Attorney, Agent, or Firm*—Baker & Hostetler LLP

(57) ABSTRACT

An support for coaxial transmission lines is described, having a reduced mass and being configured to reduce bending stresses when subject to insertion or axial load effects.

3 Claims, 7 Drawing Sheets

INNER CONDUCTOR SUPPORTS FOR RIGID COAXIAL TRANSMISSION LINES

FIELD OF THE INVENTION

The present invention relates generally to transmission line inner conductor support. More particularly, the present invention relates to light weight inner conductor support systems and methods for rigid coaxial transmission lines.

BACKGROUND OF THE INVENTION

With the advent of digital television, it has become increasingly important that transmission lines carrying broadcast signals to broadcast antennas convey the signals with minimal attenuation and signal distortion. Conventional transmission lines of the broadcast caliber are usually coaxial in nature and very long, being fabricated from joining several smaller coaxial transmission lines together. To maintain the necessary separation between the inner conductor and outer conductor of the coaxial transmission line, series of insulating supports are interspersed within the line at specified locations. The insulating support structures in the coaxial transmission line are subject to several significant loads over their life cycle.

Lines mounted horizontally subject all the supports to a nominal radial load that is proportional to the weight of the inner conductor divided by the number of supporting insulating supports. Lines mounted vertically subject the first support in each section to an axial load at least equal to the weight of the inner conductor plus the forces encountered during the normal differential expansion which occurs between the inner conductor and the outer conductor during power up or power down. Accordingly, for transmission lines that are vertically mounted, the first insulating support or anchor support is subject to a higher load due to axial forces in the transmission line than the load due to radial forces on the individual supports.

Other forms of loads may affect the transmission line such as those associated with the transportation and the installation of the line. For example, it should be understood that radial loads on the individual insulating supports are typically a fraction of the shock load (due to the inertia of the inner conductor) while the axial load on the anchor or end insulator support will equal the entire shock load due to the mast of the inner conductor. Also, there is an axial force called the insertion force associated with the process of forming the connection between successive sections of lines. Again, the axial forces on the anchor or end insulator support is understood to be greatly in excess of the radial loads anticipated on the individual supports.

Also, during the fabrication process, the inner conductor with all its internal support structures must be inserted into the outer conductor and pushed through the entire length of the transmission line section to arrive at its final position. Due to variations or irregularities in the outer conductor diameter or interior finish, for example, the insulating supports are subject to axial forces up to a maximum of the total insertion force (in the case where a single insulating support is the cause of the resistance). These loads are different from the radial loads typically encountered by the inner supports when under normal operating conditions. Therefore, these fabrication loads can be very large and primarily axially directed rather than radially (though there may be an occasional significant radial component).

It should be apparent from the above that the insulating supports' greatest force loading will be due to axial forces rather than conventionally imagined radial forces. In this regard, conventional state-of-the art practices for supporting the inner conductor of rigid coaxial transmission lines have generally been of two types: dielectric pins oriented radially outward from the inner conductor or a disc of dielectric material or puck modified to have mass removed from the interior while retaining sufficient strength to perform the supporting function. These objects are manufactured from an electrically insulating material, generally either of ceramic or plastic composition. The radial forces are carried as compressive loads while axial loads are carried as bending loads, like a beam.

Conventional approaches to addressing the radial and axial loads rising from fabrication and supporting the transmission line have been directed to simply adding to the axial thickness or more material to the supports to accommodate the additional stresses. While the added mass may be effectively compensated for, on the average, by reducing the diameter of the inner section, manufacturing variations become proportionally greater increasing the perturbations of signals in the transmission line.

Therefore, there has been a long standing need in the transmission line community for providing systems and methods for a center conductor support implementation that reduces support mass while providing transmission line integrity.

SUMMARY OF THE INVENTION

The foregoing needs are met, to a great extent, by the present invention, wherein difficulties in the prior art are mitigated by using specially configured members to form insulating supports subject to reduced bending and frictional forces. These and other advantages of the invention are discussed in greater detail below.

In accordance with one embodiment of the present invention, systems and methods for an improved coaxial transmission line anchor insulating support are provided by an inner conductor insulating support, comprising an insulating perimeter ring, an outer portion of which is substantially conformal to the outer conductor, an inner portion of which is substantially displaced from the inner conductor, and a plurality of insulating center conductor facing prongs, which are disposed at symmetric angles about the perimeter ring, and extend from the perimeter ring in alternating off-radial angles, the prongs being sufficiently long so as to contact the inner conductor.

In accordance with another embodiment of the present invention, an inner conductor to outer conductor coaxial transmission line insulating support is provided, comprising an insulating perimeter ring, an outer portion of which is substantially conformal to the outer conductor, an inner portion of which is substantially displaced from the inner conductor; and a plurality of insulating center conductor facing prongs, which are disposed at symmetric angles about the perimeter ring and all extend from the perimeter ring at an angle that intersects a common point, the prongs being sufficiently long so as to contact the inner conductor.

In accordance with yet another embodiment of the present invention, a non-anchor inner conductor to outer conductor coaxial transmission line insulating support is provided, comprising a first support member extending from a first member hole in the inner conductor, and a second support member extending from a second member hole in the inner conductor, an outer portion of the second member being joined to the first member at an outer portion of the second member being joined to the first member at an outer portion of the second member to form an angled support, wherein an outer periphery of the joined portion abuts the outer conductor.

In accordance with yet another embodiment of the present invention, an inner conductor to outer conductor coaxial transmission line insulating support is provided, comprising a conically shaped insulating support of sufficient length to abut the outer conductor at the tip of the support, and having base portion conforming to the contour of the inner conductor, and a plurality of prongs disposed about a base of the support, wherein the prongs are matched to holes in the inner conductor.

In accordance with yet another embodiment of the present invention, an inner conductor to outer conductor coaxial transmission line insulating support is provided, comprising a hollow insulating support in the shape of a quadro-pod, wherein edges of the support are substantially thick to form reinforcing ribs, wherein the base of the support is conformed to a contour of the inner conductor and the support having a sufficient height to abut the outer conductor at the top of the support, and a plurality prongs disposed about corners of the base of the support that are co-located with holes in the inner conductor.

In accordance with yet another embodiment of the present invention, an inner conductor to outer conductor coaxial transmission line insulating support is provided, comprising an insulating support having trusses of insulating material to form a truss-like tetrahedral support structure, wherein the base of the support is conformal to a contour of the inner conductor, and the support having a sufficient height to abut the outer conductor at the top of the support, and a plurality of prongs disposed about corners of the base of the support that are co-located with holes in the inner conductor.

In accordance with yet another embodiment of the present invention, a method for supporting an inner conductor within an outer conductor of a coaxial transmission line is provided, comprising the step of inserting an inner conductor support onto an inner conductor, the support having an insulating perimeter ring, an outer portion of which is substantially conformal to the outer conductor, an inner portion of which is substantially displaced from the inner conductor, wherein the insulating support has a plurality of insulating center conductor facing prongs, which are disposed about the perimeter ring, and extend from the perimeter ring in alternating off-radial angles, the prongs being sufficiently long so as to contact the inner conductor.

In accordance with yet another embodiment of the present invention, a method for supporting an inner conductor within an outer conductor of a coaxial transmission line is provided, comprising the step of inserting an inner conductor support over an inner conductor, the support having an insulating perimeter ring, an outer portion of which is substantially conformal to the outer conductor, an inner portion of which is substantially displaced from the inner conductor, wherein the support has a plurality of insulating center conductor facing prongs, which are disposed about the perimeter ring, and extend from the perimeter ring in alternating off-radial angles, the prongs being sufficiently long so as to contact the inner conductor.

In accordance with yet another embodiment of the present invention, a method for supporting an inner conductor within an outer conductor of a coaxial transmission line is provided, comprising the step of inserting an inner conductor support over an inner conductor, the support having an insulating perimeter ring, an outer portion of which is substantially conformal to the outer conductor, an inner portion of which is substantially displaced from the inner conductor, wherein the support has a plurality of insulating center conductor facing prongs, which are disposed about the perimeter ring and all extend from the perimeter ring at an angle that intersects a common point, the prongs being sufficiently long so as to contact the inner conductor.

In accordance with yet another embodiment of the present invention, a method for supporting an inner conductor within an outer conductor of a coaxial transmission line is provided, comprising the step of inserting an inner conductor support over an inner conductor, the support having a first support member extending from a first member hole in the inner conductor and a second support member extending from a second member hole in the inner conductor, an outer portion of the second member being joined to the first member at an outer portion of the second member to form an angled support, wherein an outer periphery of the joined portion abuts the outer conductor.

In accordance with yet another embodiment of the present invention, a method for supporting an inner conductor within an outer conductor of a coaxial transmission line is provided, comprising the step of inserting an inner conductor support over an inner conductor, the support having a conically shaped insulating support of sufficient length to abut the outer conductor at the tip of the support and having base portion conforming to the contour of the inner conductor and a plurality of prongs disposed about a base of the support, wherein the prongs are matched to holes in the inner conductor.

In accordance with yet another embodiment of the present invention, a method for supporting an inner conductor within an outer conductor of a coaxial transmission line is provided, comprising the step of inserting an inner conductor support over an inner conductor, the support having a hollow insulating support in the shape of a quadro-pod, wherein edges of the support are substantially thick to form reinforcing ribs, wherein the base of the support is conformed to a contour of the inner conductor, the support having a sufficient height to abut the outer conductor at the top of the support and a plurality prongs disposed about corners of the base of the support that are co-located with holes in the inner conductor.

In accordance with yet another embodiment of the present invention, a method for supporting an inner conductor within an outer conductor of a coaxial transmission line is provided, comprising the step of inserting an inner conductor support over an inner conductor, the support having an insulating support having trusses of insulating material to form a truss-like tetrahedral support structure, wherein the base of the support is conformal to a contour of the inner conductor, the support having a sufficient height to abut the outer conductor at the top of the support and having a plurality of prongs disposed about corners of the base of the support that are co-located with holes in the inner conductor.

In accordance with yet another embodiment of the present invention, an inner conductor to outer conductor coaxial transmission line insulating support is provided, comprising a first supporting means for securing the inner conductor within the outer conductor, wherein the supporting means is formed of an electrically insulating material and is asymmetrically shaped about the inner conductor, wherein the securing means is affixed via inner conductor-side prongs to a radial sector of the inner conductor via holes in the inner conductor; and a second supporting means for securing the inner conductor within the outer conductor, wherein the supporting means is formed of an electrically insulating material and is asymmetrically shaped about the inner conductor, wherein the securing means is affixed via inner conductor-side prongs to another radial sector of the inner conductor via holes in the inner conductor In accordance with yet another embodiment of the present invention, a coaxial transmission line is provided, comprising an inner electrical energy conducting means, an outer electrical energy conducting means, and an axial securing means for securing the outer conductor with respect the inner conductor, wherein the outer securing means is formed of an electrically insulating material and is circular about its outer periphery with inner conductor facing opposing prongs about its inner periphery.

In accordance with yet another embodiment of the present invention, a coaxial transmission line is provided, comprising an inner electrical energy conducting means, an outer electrical energy conducting means, and a first a plurality of securing means for securing the inner conductor within the outer conductor, the plurality of securing means being arranged radially along the inner conductor, wherein the securing means is formed of an electrically insulating material and is asymmetrically shaped about the inner conductor, wherein the securing means is affixed via inner conductor-side prongs to the inner conductor via holes in the inner conductor.

There has thus been outlined, rather broadly, certain embodiments of the invention in order that the detailed description herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
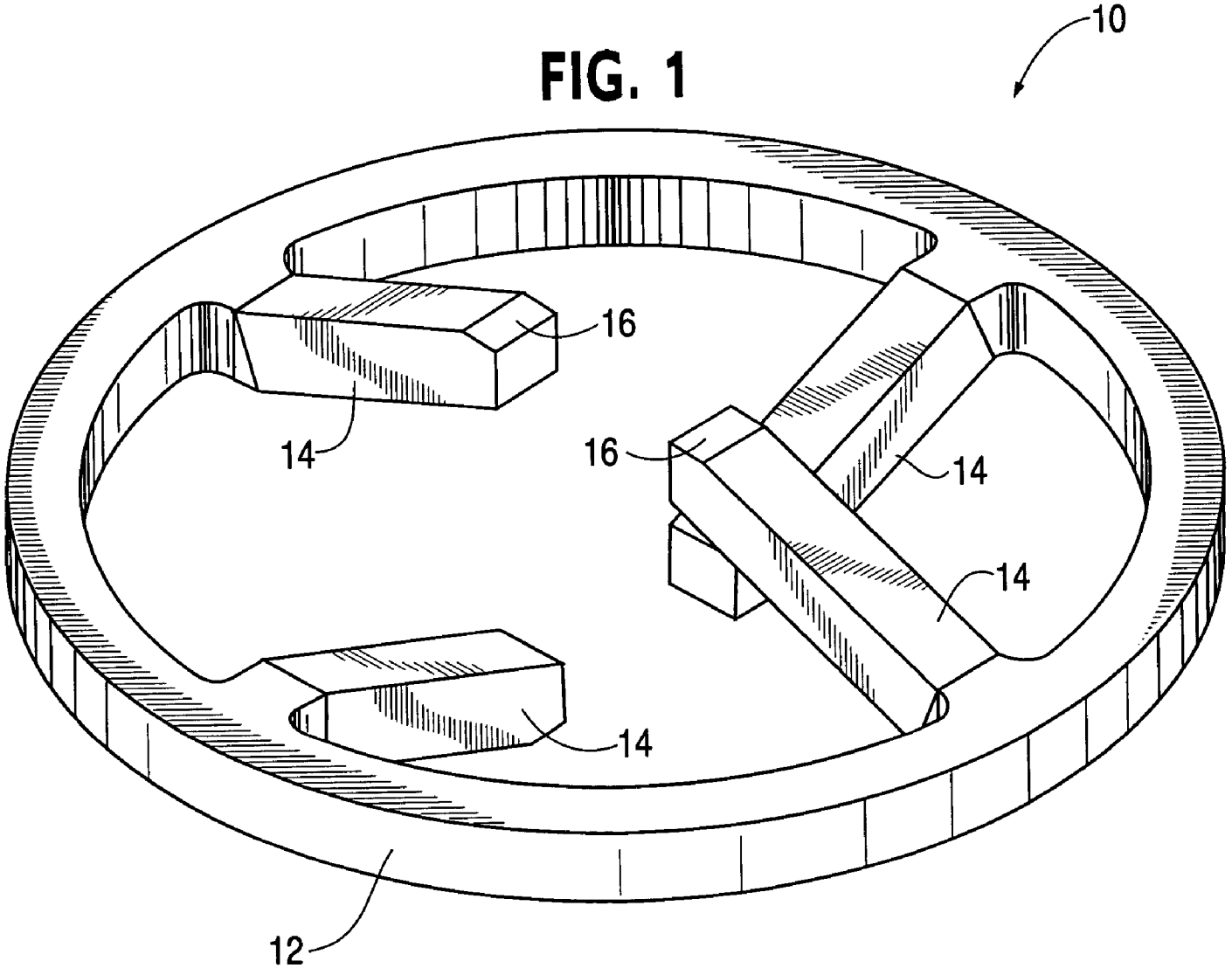
FIG. 1 is a prospective view of an exemplary support according to this invention.

The invention will now be described with reference to the drawing figures, in which like reference numerals refer to like parts throughout.

FIG. 1 illustrates an exemplary support structure 10 according to a preferred embodiment of this invention. The structure 10 contains an outer support ring 12 with a plurality of "inward" facing prongs 14 radially orientated and offset from each other at the center conductor junction point. The prongs 14 are supported at the outer periphery by the support ring 12 at intervals that are at approximately 90°. Through the prongs 14 are shown as being substantially straight members with a beveled edge 16, it should be appreciated, however, that the prongs may be curved to afford the same effect. The prongs 14 are also illustrated as having offset symmetric angles with each other from the plane of the structure 10. By having offset symmetric angles, the prongs 14 provide support at both sides of the support 10 and helps maintain upright stability.

The exemplary structure 10 has the advantages of being a support structure capable of withstanding the anticipated loads associated with the anchor support. The configuration of the exemplary support structure 10 of FIG. 1 reduces or eliminates bending loads on the support and replaces them with axial compression or tensile loads on the prongs 14, much like the spokes of a bicycle wheel.

Figure 2:
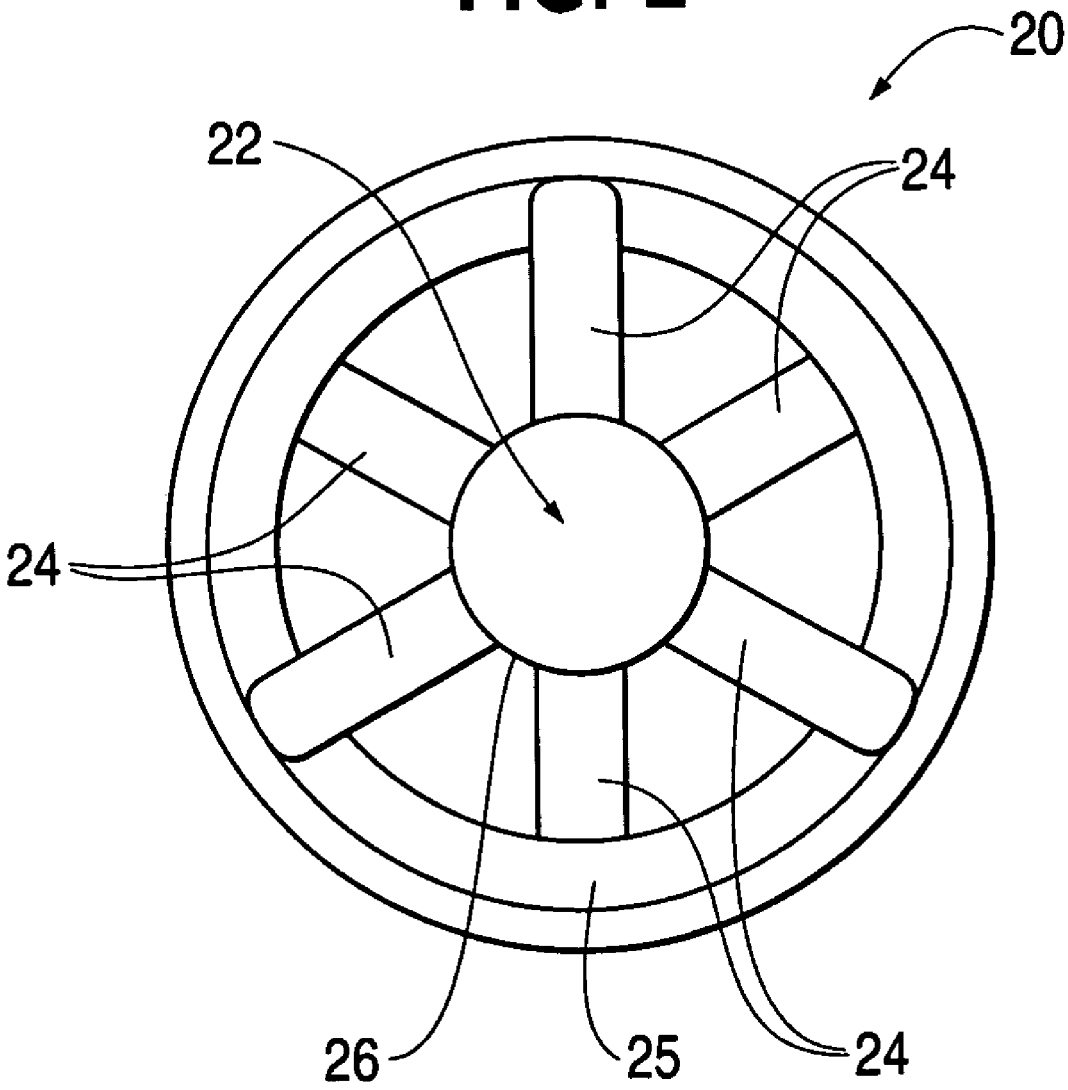
FIG. 2 is a front view of a pair of alternative exemplary supports.

FIG. 2 is a front view of a pair of modified exemplary anchor supports 20 positioned over an anchor connector assembly 22. The exemplary support(s) 20 has prongs 24 similar in design to the prongs 14 of FIG. 1. However, the inner ends of the prongs 24 are shown as being constrained by a inner prong support 26, having a contour that matches the inner conductor. The outer portion of the prongs is also supported at the outer periphery by a stepped support ring 25.

Figure 3:
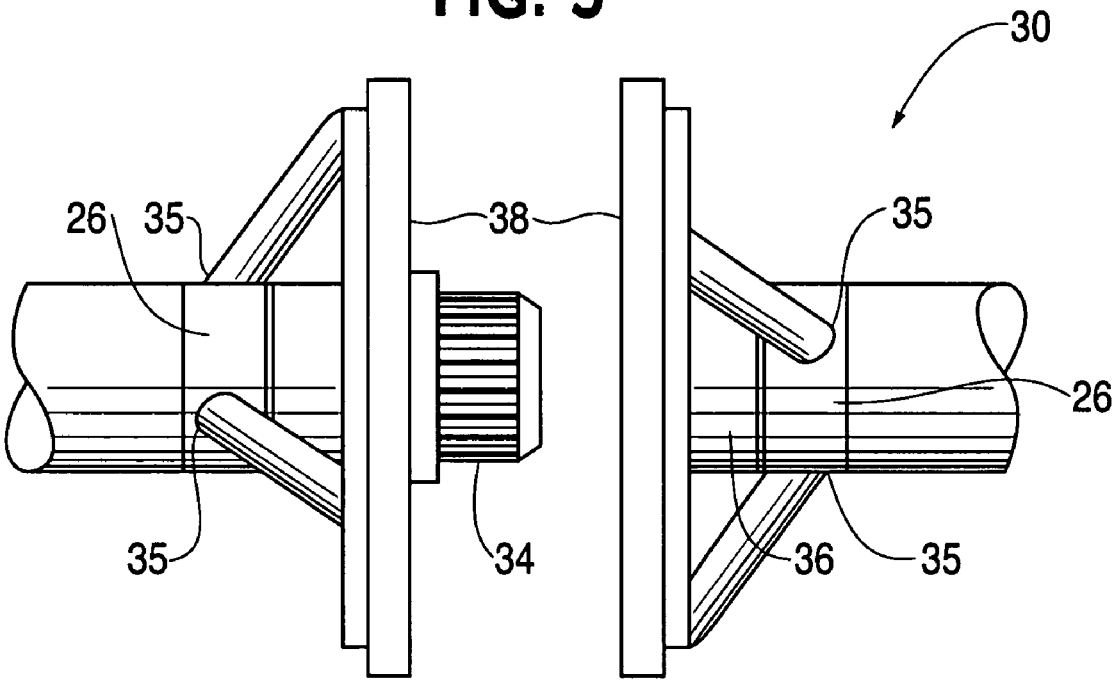
FIG. 3 is a side view of a pair of the exemplary supports of FIG. 2.

FIG. 3 is a side view of a pair of the exemplary anchor supports 20 of FIG. 2 positioned over the anchor connector assembly 22. The anchor connector assembly 22 is formed by the junction of two pieces of the inner connector of a transmission line having a male end 34 and a female end 36. Each support 20 is configured so that the faces 38 mate with each other when the supports 20 are properly positioned at the male end 34 and female 36 of the inner conductor when the connector is joined together.

The exemplary anchor support 20 can be considered as a "half image" variant of the support of FIG. 1. That is, the support 20 can be arrived at by generally taking, in essence, the support of FIG. 1 and splitting it along the center of the support ring 12. It should be noted, that the prongs of the exemplary embodiments of FIGS. 2 and 3 are illustrated as being spaced 120° from each, while the prongs of the exemplary embodiment of FIG. 1 illustrated as being separated by 90°. Of course, it is understood that the separation angle is a design preference, and may be varied without departing from the spirit and scope of this invention. Additionally, as one of many alternatives, the tips of the prongs 24 may be configured without the inner prong support 26 and inserted into holes 35 of the inner conductor to secure the support 20, as desired. Further, while FIGS. 2–3 show the outer support ring 25 as being stepped, non-stepped, or otherwise alternate contours may be used as desired.

Due to the angles employed for the prongs, the beam type loading of the prior art is converted to compression and tensile loads which may be borne by members having significantly reduced cross section and associated mass. Additionally, as stated above, with the decrease in the mass of the insulator support 20, significant reduction of costs and decreases in signal perturbation can be achieved.

Figure 4:
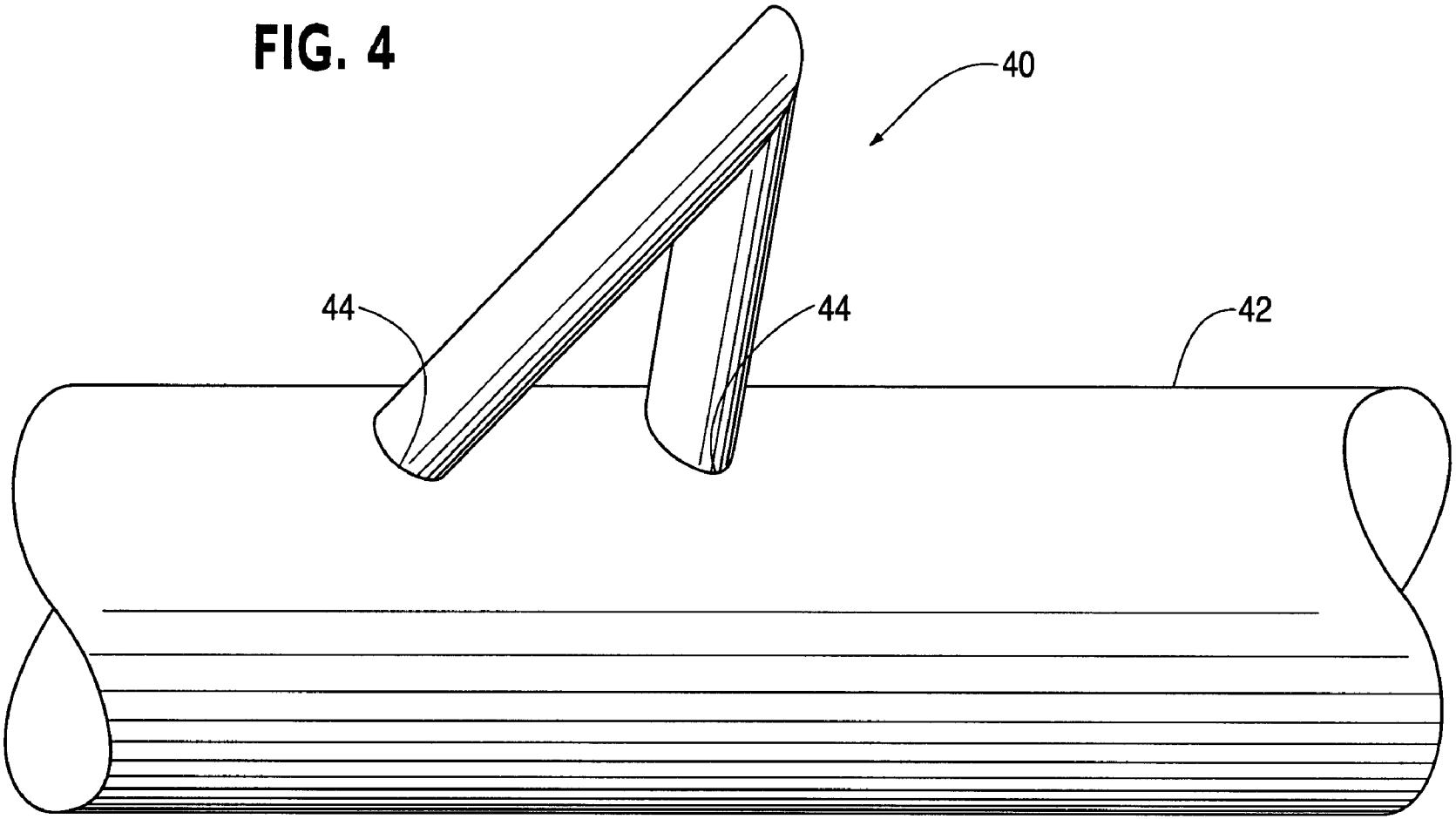
FIG. 4 is a side view of an another alternative exemplary support.

FIG. 4 illustrates another exemplary embodiment of an intermediate (or non-anchor) support structure. An angle support arm 40 is shown protruding from an inner conductor 42 via holes 44 in the inner conductor 42. The support 40 may be formed by "bending" a rod of insulating material, for example. Alternatively, it may be formed by stamping, milling, casting, etc., or by any now or future known method for conforming suitable material to the shape shown in FIG. 4. The general support 40 can be retained within the inner conductor 42 by any one or more of commonly or future arrived methods for securing the support arm 40. For example, the surface of the insulator support 40 may be milled in a manner to form an indent or fitting ring for the holes 44 thereby enabling the support 40 to "snap" into place. Additionally, the support 40 may traverse the entire diameter of the hollow inner conductor 42 and thus be fixed within the inner conductor 42.

Though FIG. 4 illustrates the insulating support 40 as having one member being longer than the other member, it should be appreciated that other shapes or forms may be configured as desired. For example, both sides of the insulating support may be of equal length. Furthermore, the insulating support 40 may be formed to have a "U-shaped" appearance, for example.

Additionally, it should be apparent that in order for the exemplary support 40 to afford complete support between the inner conductor and the outer conductor, a plurality of supports 40 should be placed at various axial locations along the inner and at various radial locations around the inner conductor, possibly at the same location as other supports.

Figure 5:
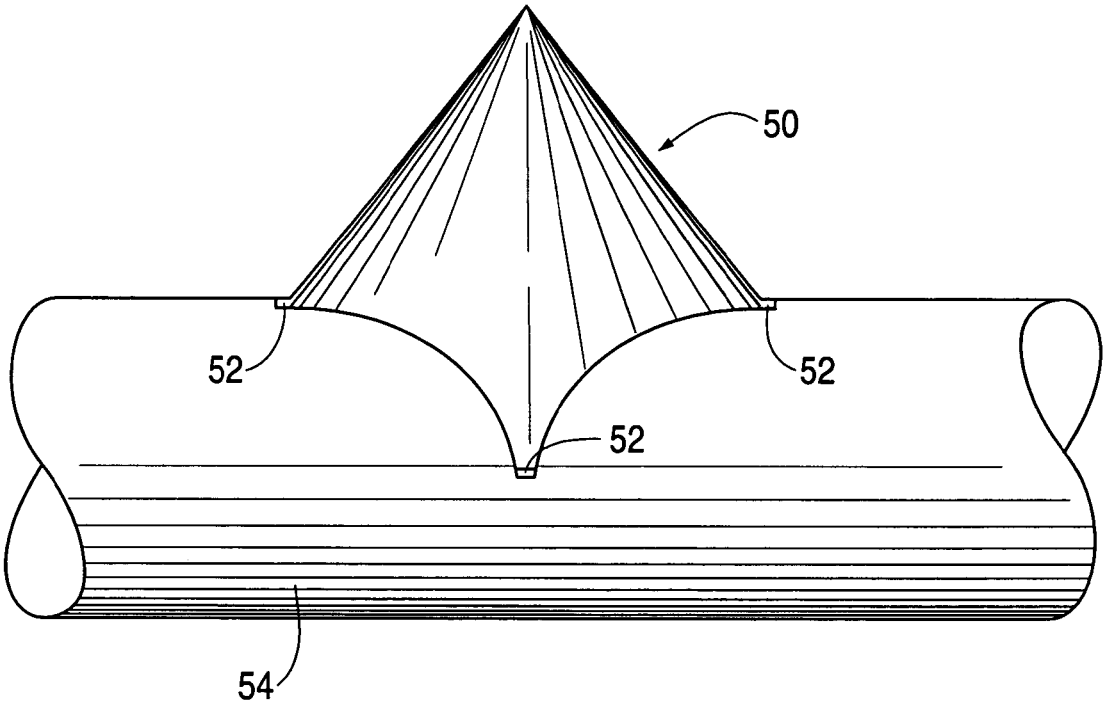
FIG. 5 is a side view of another alternative exemplary support.

FIG. 5 illustrates another exemplary support embodiment 50 having a hollow cone-like structure. The inner conductor side of the support 50 is terminated with insertion prongs 52 at the "corners" of the support 50. The prongs 52 provide the support 50 the ability to be fixed to the inner conductor 54 via the insertion holes 56 (obstructed from view). The support 50 is illustrated as being generally in the shape of a cone, with the base portion of the cone conformed to the contour of the surface of the inner conductor 54. The support 50 is illustrated as being hollow throughout its entirety, however, various sections of it may be solid, for added reinforcement, as desired. Also, the base of the support 50 may be shaped to allow a greater or lesser plurality of prongs 52 to be formed, than the four (one obstructed from view) shown.

Figure 6:
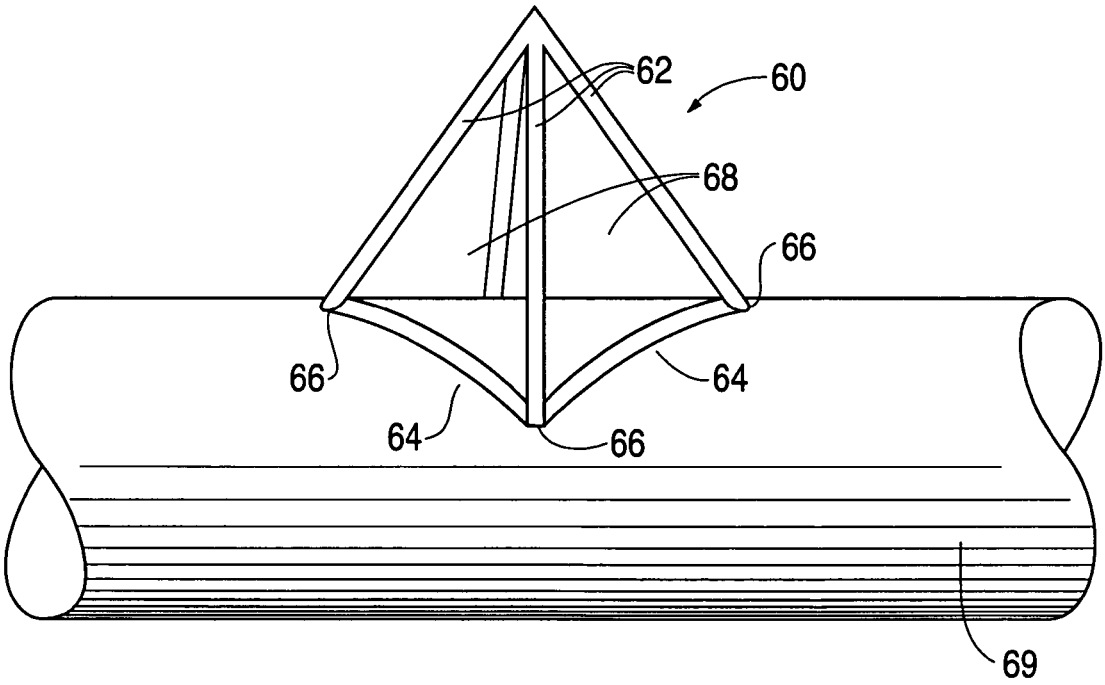
FIG. 6 is a side view of another alternative exemplary support.

FIG. 6 illustrates another exemplary support embodiment 60 having a quadro-pod like structure. The support 60 is configured to be similar in many respects to the embodiment of FIG. 5. However, rather than having a conical shape, the exemplary embodiment of FIG. 6 has a semi-tetrahedral or quadro-pod shape. Further, ribs 62 are formed at the "corners" of the support 60 and at the base edge 64. Webbed surface 68 spans the ribs to add additional support. Prongs 66 affix the support 60 to holes in the inner conductor 69.

Figure 7:
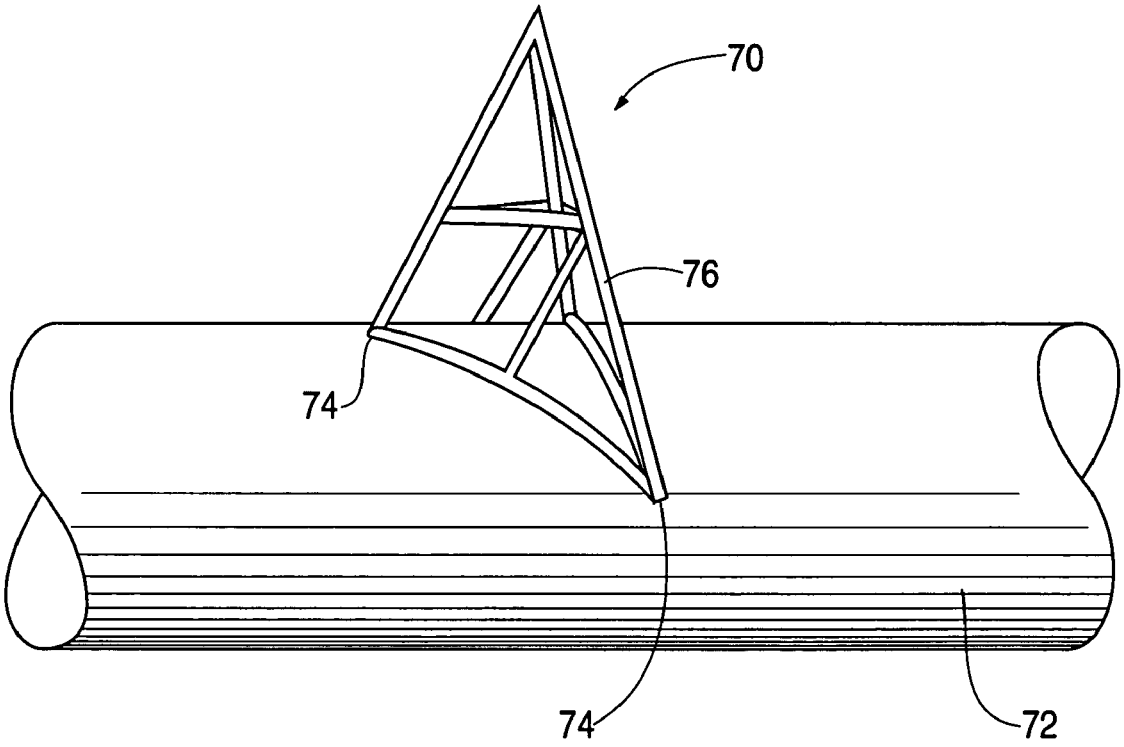
FIG. 7 is a side view of another alternative exemplary support.

FIG. 7 illustrates another embodiment of an exemplary support 70 having a truss-like structure. The base of the base of the support 70 is configured to conform to the surface of the inner conductor 72 and is attached to the inner conductor 72 via prongs 74 and holes (obstructed from view) in the inner conductor 72. Trusses and their various shapes are well known in the art and therefore the available different variations of designs and shapes are not further discussed.

It should be apparent that the above exemplary embodiments provide systems and methods for at least reducing axial stresses on the supports. Accordingly, various types of light weight structures, shapes, configurations exploiting the various support shapes shown above may be implemented according to the knowledge of one of ordinary skill in the art without departing from the spirit and scope of this invention. It should be appreciated that due to the reduced mass of the exemplary supports described herein, significant reduction in cost of dielectric material such as TFE (Teflon) and PFA (Teflon based polymer) which are commonly used in these applications, can be achieved. Other costs and performance related benefits can be achieved depending on the particular choice of materials used.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An inner conductor to outer conductor coaxial transmission line insulating support, comprising:

a first support member extending from a first member hole in the inner conductor; and a second support member extending from a longitudinally-displaced second member hole in the inner conductor, an outer portion of the second member being joined to the first member at an outer portion of the first member to form an asymmetrically-angled support, wherein an outer periphery of the joined portion abuts the outer conductor.

2. A method for supporting an inner conductor within an outer conductor of a coaxial transmission line, comprising the step of:

inserting an inner conductor support over an inner conductor, the support having a first support member extending from a first member hole in the inner conductor and a second support member extending from a longitudinally-displaced second member hole in the inner conductor, an outer portion of the first member being joined to the first member at an outer portion of the second member to form an asymmetrically-angled support, wherein an outer periphery of the joined portion abuts the outer conductor.

3. A coaxial transmission line, comprising:

an inner electrical energy conducting means;

an outer electrical energy conducting means; and a first plurality of securing means for securing the inner conductor within the outer conductor, the plurality of securing means being arranged radially along the inner conductor, wherein the securing means is formed of an electrically insulating material and is asymmetrically shaped about a longitudinal axis of the inner conductor, wherein the securing means is affixed via inner conductor-side prongs to the inner conductor via holes in the inner conductor and abutts the outer conductor at an outer portion of a joint formed by asymmetrical members of the securing means.

* * * * *